United States Patent [19]

Blechstein

[11] 4,349,593

[45] Sep. 14, 1982

[54] DOUBLE KNIT FABRIC PROCESSING INTO DECORATIVE GOODS

[75] Inventor: Amihud Blechstein, Philadelphia, Pa.

[73] Assignee: Penn-Gil Fabrics, Inc., Spring House, Pa.

[21] Appl. No.: 251,209

[22] Filed: Apr. 6, 1981

[51] Int. Cl.[3] ..... E04F 13/00

[52] U.S. Cl. ..... 428/40; 118/34; 427/173; 427/176; 427/389.9; 427/393.3; 428/253; 428/254; 428/354; 428/920

[58] Field of Search ..... 428/40, 253, 254, 354, 428/920, 483, 290; 427/173, 176, 393.3, 389.9; 28/169; 118/34

[56] References Cited

U.S. PATENT DOCUMENTS

| | | | |
|---|---|---|---|
| 2,813,052 | 11/1957 | Lancaster | 154/95 |
| 2,837,440 | 6/1958 | Bowin | 427/173 |
| 3,440,133 | 4/1969 | Burnett | 161/89 |
| 3,616,146 | 10/1971 | Gabet | 161/88 |
| 3,962,510 | 6/1976 | Worcester et al. | 428/245 |
| 4,052,521 | 10/1977 | Ferrari | 427/176 |
| 4,159,360 | 6/1979 | Kim | 428/195 |

*Primary Examiner*—James J. Bell

*Attorney, Agent, or Firm*—Bernard M. Weiss

[57] ABSTRACT

The utilization of double knit fabrics is extended to fields other than their conventional employment in wearing apparel. This is accomplished by dimensionally stabilizing the otherwise easily distortable double knit material by applying to one surface thereof a controlled layer of a latex of a polymeric coating composition comprising a copolymer of ethylene and vinyl chloride in an aqueous vehicle. The thus coated material is properly cured and dried.

11 Claims, 2 Drawing Figures

DOUBLE KNIT FABRIC PROCESSING INTO DECORATIVE GOODS

The present invention relates to the processing of double knit fabrics whereby they are stabilized and made suitable for use as wall coverings, upholstery and drapery products.

BACKGROUND OF THE INVENTION

1. Field of the Invention

Knitting was an early invention of man. The earliest known knitted fabric is a pair of thick, handknitted wool socks found in an Egyptian tomb dating back to the 4th century B.C. Knitted fabrics are divided into two generaly types: (1) those produced by weft knitting, where one continuous yarn forms course across the fabric; and (2) those produced by warp knitting, where a series of yarns forms wales in the lengthwise direction of the fabric.

There are three fundamental stitches in weft knitting. They are (1) plain knit stitch, (2) purl stitch and (3) rib stitch. Rib-knit type fabrics have alternating lengthwise rows of plain and purl stitches constructed so that the face and back of the fabric appear alike. The double-knit stitch is a variation of the rib stitch.

Broadly defined, a double knit is a jersey construction knitted on a machine equipped with two sets of needles so that, in effect, the cloth is a "twice knitted" fabric in which, by the action of the double set of needles the two sides of the cloth are interlocked. The fabric resulting is heavier than a single-knit cloth. One side has a fine ribbed appearance and the reverse side the texture of a fine birdseye or diamond effect. The heavier, double knit construction makes the fabric more dimensionally stable than plain jersey and allows it to be cut without curling on the edges.

Double knit fabrics, particularly those made by a circular knitting method, had a tremendous growth in the apparel field. These fabrics are more pliable and elastic than fabrics constructed by other methods. Thus, they are especially adaptable for form-fitting garments such as hoisery, undergarments, foundation garments, sweaters, and sleepwear. They can be given durable creases for use in tailored suits, jackets and slacks. Fiber material used is most often wool, acetate, nylon, triacetate, acrylics, cotton, polyester and combinations thereof, but possibilities include all fibers and even paper yarns.

With advances in double knitting processes and machinery, the use of knitted fabrics in the apparel field became phenomenal. This exploding growth eventually led to excess capacity in the industry, which in turn fostered much poor quality goods and eventually the rejection of double knit fabric for many applications. The cessation in making many products out of this material resulted in very many double knit machines being idled. A large portion of these machines were purchased on extensive credit and their non-usage is a severe disadvantage to their owners. This invention relates to a way by which the marketability of double knits can be expanded considerably into non-apparel fields for making goods such as wall coverings, upholstery materials and draperies. These idled machines could thus be put back into operation.

In the case of double knit fabrics as well as in plain or single knit fabrics the outward exposed surface is generally called the "face" or "front" while the reverse side is designated the "back" or "back side". It is in this sense that these terms are employed in the description which follows.

2. Description of the Prior Art

In U.S. Pat. No. 3,616,146 there is proposed an adhesive sheet material in which the textile fabric carrier has been made hydrophobic and to which a continuous impermeable plastic resinous film is applied for minimizing stretch and fraying. A dried adhesive is applied over the coating capable of being activated by a liquid medium such as water or a solvent prior to use.

A wall covering is proposed in U.S. Pat. No. 3,962,510 having a long dimension and a short dimension and comprising a laminate of a facing material bonded to a woven fabric backing material. The backing material is woven with warp and filling yarns and each filling yarn comprises a percentage of thermoplastic fibers. The fibers remaining in each of the filling yarns and the warp yarns are not able to be autogenously bonded to the facing material. The warp yarns lie in the direction of the long dimension and the filling yarns are in the direction of the short dimension. Therefore, the wall covering is rendered more stiff and less flexible in the direction of its short dimension as compared to its long dimension.

U.S. Pat. No. 4,159,360 discloses stabilized fabrics which may be woven, knitted or tufted. The fabric layer is bonded to a stabilizing layer of staple or continuous filament fibers by an air-permeable bonding layer of thermoplastic material. Bonding is achieved by heat and pressure sufficient to melt the bonding layer and let it penetrate into the fibers of both the fabric and stabilizing layers.

In U.S. Pat. No. 2,813,052 there is disclosed a composite water-proof plasticized fabric and a method of making the same. It is especially addressed to knitted, netted or textile fabrics having substantial stretchability in all directions. U.S. Pat. No. 3,440,133 discloses a coated, knitted fabric that has a relatively high ratio of percentage stretch in its wales direction to its courses direction. Such fabric is said to be particularly useful as a covering material in the upholstery industry.

It is suggested in the prior patented art that by coating or impregnation of knitted as well as woven textile fabrics these can be dimensionally stabilized sufficiently to enable their utilization as wall coverings and/or upholstery materials. Such treated materials have been commercially successful only in the case of woven fabrics which are being utilized fairly extensively in upholsery and to a lesser extent as wall coverings. Knit fabrics, because of their high degree of stretch, pliability, susceptibility to distortion of the pattern of the courses and/or wales of the knit yarns, even when coated, impregnated or otherwise treated by hitherto known methods, could not be successfully stabilized to enable their practical use as wall coverings and upholsering fabrics. By treatment of the knitted fabric with a sufficiently large amount of coating material to stabilize the fabric, the material becomes too stiff for practical handling. Lesser amounts of coating composition applied to the fabric does not provide the desired degree of stabilization.

SUMMARY OF THE INVENTION

In accordance with the present invention the utilization of double knit textile fabrics is extended and made practical in fields other than their conventional employment in wear apparel. This is accomplished by dimensionally stabilizing the otherwise readily distortable double knit material through the application to one surface thereof a controlled layer of a latex of a polymeric coating composition comprising a copolymer of ethylene and vinyl chloride in an aqueous vehicle. In this manner the double knit fabric is rendered inert to stretching and is stabilized not only against dimensional distortion lengthwise and widthwise but also against stretch along a 45° angle.

In accordance with a preferred embodiment of the invention the applied polymeric latex coating composition also comprises flame retardant chemicals so that the final stabilized fabric material is made fire resistant.

Thus, the product obtained by the present invention overcomes the otherwise present problems of stretch, distortion, limpness and flammability and enables the utilization of double knit fabrics in such hitherto impractical fields as for use in wall coverings, upholstery and drapery fabrics.

In practical application of the invention the double knit textile fabric is passed over a coating applicator by means of which there is applied to the back of a running length of the fabric a controlled amount of the polymeric coating composition comprising the ethylene-vinyl chloride copolymer adjusted to desired viscosity by addition of a minor amount of sodium polyacrylate. The thus coated fabric is then passed through a curing and drying chamber while maintained under lateral tension or in a transversely fixed position. Additional fire retardant material may be applied prior to the curing stage if needed or desired to meet fireproofing codes or customer specifications.

BRIEF DESCRIPTION OF THE DRAWINGS

The operation of the invention will be understood and its several features and advantages appreciated from the detailed description which follows, read in connection with the accompanying drawings, wherein.

DETAILED DESCRIPTION

Figure 1:
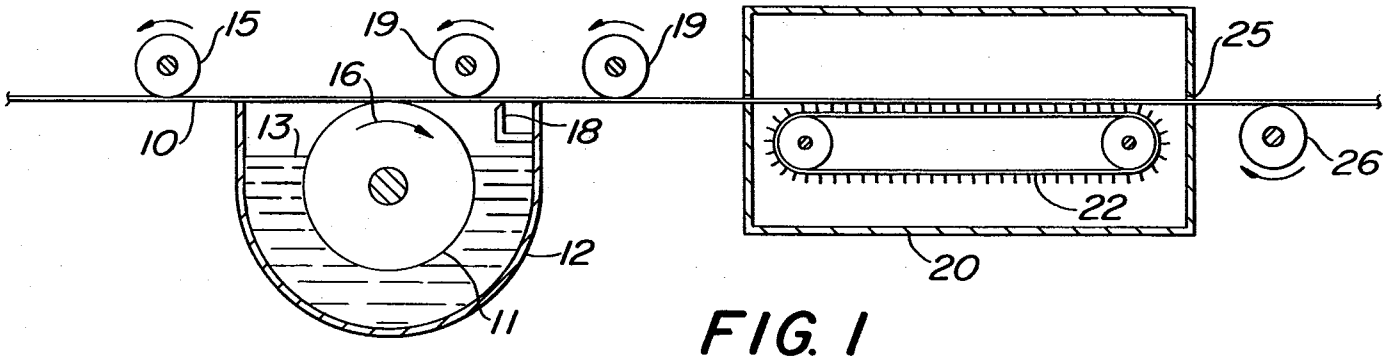
FIG. 1 is a schematic representation of a typical method of producing the product of the present invention.
Figure 2:
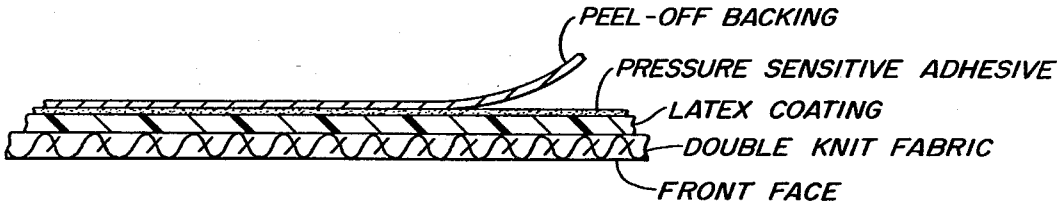
FIG. 2 is an exaggerated diagrammatic view in cross-section of the coated double knit product, with parts being broken away for clarity.

As shown in FIG. 1 of the drawings, a running length of the double knit fabric 10, as it is unwound from a storage roll (not shown) is passed in contact with a coating roll 11 by means of which the coating composition is applied to one surface of the fabric. In the more typical case the coating will be applied to the back side of the fabric, that is the side opposite that which is to be exposed to view when the fabric is to be used as a wall covering, upholstery cloth or the like. Roll 11 rotates within the trough 12, which contains the coating composition in liquid form up to the level indicated by line 13. Roll 11 thus serves as a pick-up roll, carrying the coating composition from its reservoir in trough 12 and deposits a controlled amount of the coating composition onto the underside of fabric 10. To maintain the desired contact between the underside of the fabric with the layer of coating composition on the pick up roll 11, one or more guide rollers 15 are provided mounted above and in contact with the upper surface of the running length of the fabric, which rollers serve to maintain the fabric in contact with the layer of coating composition on roll 11.

The amount of coating composition applied to the fabric is determined and can be controlled by the speed of the pick up roll, and the direction of rotation of the pick up roll. As will be understood, if the pick up roll is rotated counter clockwise or opposite to the direction of the longitudinal movement of the fabric, a greater amount of the coating composition will be applied than in the illustrated embodiment (shown by the arrow 16 in FIG. 1) wherein the pick up roll 11 rotates clockwise or in the fabric moving direction. The guide rollers 15 may be freely-rotating idler rollers arranged for vertical adjustment of their axes relative to the upper periphery of roll 11.

Further control of the thickness of the layer and uniformity of distribution of the coating composition to the under surface of the fabric is obtained by the provision of a doctor blade or scraping knife 18, which removes excess coating material from the deposited layer. Pressure rollers 19 are provided approximate both sides of the upper edge of 18, floatably mounted to rest on the uncoated upper surface of the fabric and operating to maintain contact between the upper edge of 18 and the coated surface of the fabric.

After the fabric 10 has been treated with the coating composition as described, it is passed through a curing and drying chamber 20 which is heated by any suitable means (not shown). Heating of the chamber may be effected, for example, by passing of heated air or other heated gas or vapor into the chamber, by use of internal heating means such as electrical or heat transfer coils, or by infra red rays directed against the coated surface of the fabric.

The coated fabric is conducted through chamber 20 in known manner by a tenter frame 22, which comprises a pair of parallel laterally spaced chains provided with upstanding gripping pins engaging the transverse edges of the fabric. The spacing between the chains is adjustable to accommodate fabrics of different width and to maintain the fabric spread to its full width or under a certain degree of lateral tension, if so desired. In any event the tenter frame maintains the fabric taut during drying and curing, thus preventing misalignment of the knitted yarns or distortion of the pattern.

The linear speed at which the fabric is passed through the chamber 20 in the embodiment illustrated, also determines the speed at which the fabric moves with respect to the upper surface of the pick up roll 11. The speed of fabric movement is thus controlled by the linear speed of the tenter frame 22. The proper curing and drying effected in chamber 20 will depend upon the temperature maintained in the chamber and the length of time that the fabric remains in the chamber at the temperature employed. The residence time, of course is determined by the length of the path provided and the linear rate of movement through such path.

After the curing and drying of the coated fabric has been effected to the desired extent, it leaves chamber 20 through exit 25, passing over one or more guide rollers 26, and is finally rewound on a take up or storage roll (not shown).

If the coating composition does not contain flame-retardant chemicals, such chemicals may be applied to the fabric before it enters chamber 20. The flame retardant material may be applied by spraying a solution or dispersion of such chemicals onto the surface of the polymer coated fabric by a brush or other type of surface applicator, or by a pick up roll similar to roll 11 employed in the initial application of the polymer latex coating eomposition. Where the initial coating applied by roll 11 already contains flame retardant chemicals, it may be necessary to supplement the same to meet flame proofing standards, in which event additional flame retardant may be applied to the initially coated fabric preferably before it enters chamber 20.

If the fabric is to be employed as a wall covering or the like, an adhesive composition may be applied to the coated surface, which adhesive is selected so as to be compatible with the cured coating and the fireproofing material on the back surface of the fabric. While such adhesive may be applied to the fabric at the place of use just before such fabric is affixed to the wall or other surface to be decorated thereby, it is found desirable in many instances to provide prospective users with a stabilized and flameproof fabric in a form ready for direct use without further significant treatment. In such instance suitable adhesive composition may be applied to the back of the fabric leaving chamber 20 before or after it is rewound on the take up or storage roll.

Most of the currently available adhesive compositions which are used in wall covering are not suitable for use with the product of the present invention. For this purpose a specially selected adhesive needs to be employed as hereinafter described. The required adhesive is one that in addition to being compatible with the coated surface of the stabilized double knit fabric, must be strong enough to hold the fabric to the wall or other surface to which the fabric is to be affixed, yet permit the fabric to be peeled from the wall or other surface to correct hanging errors that may have occurred, so that the fabric may be reapplied to the wall or other surface without deterioration of the adhesive or its bonding properties.

The required or desired amount of coating composition to be applied to the fabric by roll 11 is governed to a certain extent by the degree of stiffness desired and depends largely upon the ultimate use of the treated fabric. In general, the coating composition prior to drying may constitute from about 3 ounces per square yard (~101.7 grams/meter$^2$) up to about 8.5 or more ounces per square yard (288.25 grams/meter$^2$), corresponding the range of from 5 ounces per 60 inch running yard to about 14.2 ounces per 60 inch running yard. Within these ranges and at the controlled solids content of the coating composition (over 40% solids) the coating composition will penetrate only the back of the double knit fabric to which the composition is applied and none of the composition will significantly appear on the opposite face of the fabric. In the drying and curing of the coating in chamber 20 most of the initial volatile liquid vehicle is removed so that the net pickup in the dried fabric leaving chamber 20 constitutes per square yard or per running yard about half of that present prior to entering the drying step.

In order to illustrate the various ranges of solids pickup for desired stabilization as applied to a typical double knit fabric which prior to coating will weigh in the order of about 8.00 to 8.25 ounces per square yard, the following examples are noted. For the coated and dried product to be used as 1 foot square panels, a solids pickup of no more than 3.3–3.6 ounces of solids per square yard is required. A higher solids pickup than this range results in higher cost of the final product without a corresponding improvement in quality. If the solids pick up is substantially higher than that indicated, as that above about 7 ounces per square yard, the final product will become too stiff to work with comfortably. It has been found experimentally that the double knit fabric can be stabilized at a dried solids pickup as low as about 2.9–3.0 ounces per square yard. But, at this low range difficulties in handling would be encountered by less experienced users because of the pliability of the fabric. The above indicated range of 3.3–3.6 ounces per square yard corresponds to 5.5–6.0 ounces per 60 inch (width) running yard. For the use of this product in 8 foot by 4 foot sheets for wall coverings, a higher solids pickup is required. It has been experimentally determined that for wall covering sheets of these indicated dimensions it is most suitable to provide fabric having 8.00 to 8.25 ounces solids per 60 inch running yard, corresponding to about 4.8–4.95 ounces per square yard of fabric.

For the experienced or professional user more pliable material, hence of lower solids content, may be supplied; since such fabric of the lower solids content is equally suitable for use and is much more economical. Thus, lowering of the solids pickup is largely a matter of economics. As long as the solids content of the dried fabric is not permitted to go below 2.9–3.0 ounces per square yard, the stability of the product will not suffer and experience will dictate the optimum ranges for marketing of the product. Preferred ranges, from present indications, are in the order of about 3.3 to about 5 ounces retained solids pickup per square yard for the dried fabric.

As hereinbefore indicated, the drying and curing temperature of the polymer coated fabric must also be controlled. In general the fabric is preferably maintained in curing and drying chamber 20 at a temperature in the range of 280°–310° F. for sufficient time to obtain substantially complete drying. Where the applied coating composition contains about 40–65% solids drying in this temperature range is effected in 1.5 to 2.0 minutes. Thus, with the length of the path through which the fabric is moved during drying and curing being fixed at 12 to 22 yards, the fabric needs to be moved through such path at 8–11 yards per minute. No substantial damage will occur by exceeding the stated drying time in chamber 20 so long as the temperature is not permitted to go too high. When low temperature and insufficient time for that temperature (higher speed through the drier) is simultaneously employed proper drying and accompanying curing will not be had and the desired stabilized fabric product is not obtained. On the other hand, at the higher temperature of the indicated range and beyond and prolonged residence time (lower speed of movement through the drier) some scorching may result. Above 400° F., for example, certain synthetic fibers, such as polyester or nylon, may begin to melt.

The adhesive found particularly suited for use on a double knit textile fabric stabilized by a coating or ethylene-vinyl chloride copolymer, is an acrylic type pressure sensitive adhesive, a particular commercially available product being Paranol F-9897 (marketed by Para-Chem Corp.). To protect the adhesive coated fabric prior to use, the adhesive layer is provided with a paper peel off backing having a release coating thereon such as silicone or wax.

The stabilizing process of the present invention is applicable to all types of double knit fabrics including those formed by circular as well as those formed by flat bed knitting machines. The tubular product formed by circular knitting is slit open to its full width prior to the usual finishing of the greige fabric by conventional steps of dry cleaning or scouring and heat setting to desired width. The thus finished double knit fabric is fed to the coating step of the present invention in open width form.

The treated product after curing and drying in chamber 20, with or without intermediate application of an adhesive layer is advanced in known manner to be wound on tubes constituting collector rolls. In general, each such roll is wound to contain 35 to 45 yards of fabric, so that the running length of fabric is mechanically measured and cut to provide the desired rolled yardage.

DESCRIPTION OF THE PREFERRED EMBODIMENT

A double knit fabric formed of 150 denier polyester, weighing about 8 to 8.25 ounces per square yard, formed by circular knitting, slit and heat-set to a width of 60 inches, is stabilized for use as a wall covering material. The fabric is coated on the backside thereof by being passed over a pickup roll dipping into a reservoir of Paranol Plastic F 10678. Paranol Plastic F 10678 is a 55% dispersion in an aqueous vehicle of a composition comprising:

| | |
|---|---|
| ethylene-vinyl chloride copolymer | 61 wt. % |
| inorganics and flameproof materials | 33 wt. % |
| modifiers and additives | 2.4 wt. % |
| sodium polyacrylate | 3.6 wt. % |

The inorganics include various flame retardant chemicals including aluminum trihydrate and alkaryl phosphate. The sodium polyacrylate is employed to adjust to desired coating viscosity. Paranol Plastic F 10678 is prepared at 55±1% total solids in aqueous media, at a pH of 8.5±0.5. It has a viscosity of 15,000±1000 cps. (Brookfield, RVF, #5 spindle @ 20 RPM).

The fabric is coated with this polymer latex composition to a weight gain of 7 ounces per running yard prior to its admission to the drying and curing chamber. Additional fire retardant chemicals are then applied prior to drying, to enable the finished fabric to pass the standard National Fire Protection Association Burn Test #701. The coating material will be applied only to the backsideof the fabric and does not significantly penetrate the opposite face of the fabric. The extra fire retardant chemicals may be applied to either or both sides of the fabric.

The coated and flame-retardant treated fabric is heated in chamber 20 at a temperature of 295° F. (146° C.) while passing through said chamber at 9 yards per minute constituting a residenct time of 1.75 minutes. The dried fabric leaving chamber 20 will contain about 4.5 ounces added solids per running yard (60 inch width).

Following the drying and curing of the coated fabric it may be treated to render the same water and stain repellent by known means, such as by coating with fluorinated acrylic or vinyl polymers, e.g. the familiar Scotch Guard type composition. As a result of such treatment the permanence of the fire retardant composition thereon is also enhanced.

The fabric is next treated with the adhesive composition which is applied by spreading a thin layer of Paranol Plastic F 9897 over the polymer coated surface and placing a polyethylene peel-off film over the adhesive layer. The finished product is wound on tubular paper cores in desired yardage, typically in the range of 35 to 45 yards per roll.

What is claimed:

1. The method of structurally stabilizing double knit fabric which comprises the step of applying to the back thereof a coating layer of a resin latex composition comprising a copolymer and ethylene and vinyl chloride having a pH of 8.5±0.5 and a Brookfield viscosity of about 15,000 as determined by RVF employing #5 spindle @ 20 RPM, and drying the coated fabric at a temperature below 400° F.

2. The method as defined in claim 1 wherein said latex comprises about 40–65% total solids.

3. The method as defined in claim 1 wherein said latex further comprises fire-retardant chemicals.

4. The method as defined in claim 3 wherein said fire retardant chemicals comprise one or more salts from the group consisting of alumina trihydrate and alkaryl phosphate.

5. The method as defined in claim 1 wherein said latex coating is applied in an amount constituting 2.9 to 3.6 ounces per square yard of the fabric.

6. The method as defined in claims 1,2, or 5 wherein said drying is effected at a temperature in the range of 280° to 310° F. for a period of 1.5 to 2.0 minutes.

7. The method as defined in claims 1 or 5 wherein said latex is applied by a pickup roll rotating in a reservoir of said latex composition, to a running length of said fabric; and said drying is effected during its moving through a heated environment while being maintained laterally extended to its full width in taut or tensioned condition.

8. A structurally stabilized double knit fabric suitable for use in wall covering application, said fabric containing on the backside thereof a dried and cured latex coating of a copolymer of ethylene and vinyl chloride.

9. A fabric as defined in claim 8 which further contains flame-retardant chemicals, rendering the same substantially fireproof.

10. A fabric as defined in claim 8 or 9 which contains 2.9 to 3.6 ounces of said dried coating per square yard of fabric.

11. A fabric as defined in claim 8 or 9 having a pressure sensitive adhesive layer applied to said latex coating, said adhesive comprising acrylic resin and being protected by a releasable peel-off backing.

* * * * *